US009333614B2

(12) United States Patent
Huang et al.

(10) Patent No.: US 9,333,614 B2
(45) Date of Patent: May 10, 2016

(54) EXTERNAL CIRCULAR POLISHER WITH DOUBLE POLISHING WHEELS

(71) Applicant: HAMMER ELECTRIC POWER TOOLS CO., LTD., Zhuji, Zhejiang (CN)

(72) Inventors: Jianchu Huang, Zhejiang (CN); Liang Huang, Zhejiang (CN)

(73) Assignee: HAMMER ELECTRIC POWER TOOLS CO., LTD, Zhejiang (CN)

( * ) Notice: Subject to any disclaimer, the term of this patent is extended or adjusted under 35 U.S.C. 154(b) by 216 days.

(21) Appl. No.: 14/119,027

(22) PCT Filed: Aug. 1, 2013

(86) PCT No.: PCT/CN2013/080587
§ 371 (c)(1),
(2) Date: Nov. 20, 2013

(87) PCT Pub. No.: WO2015/013940
PCT Pub. Date: Feb. 5, 2015

(65) Prior Publication Data
US 2015/0183075 A1 Jul. 2, 2015

(51) Int. Cl.

| | |
|---|---|
| ***B08B 9/023*** | (2006.01) |
| ***B24B 33/04*** | (2006.01) |
| ***B24B 23/02*** | (2006.01) |
| ***B24B 5/00*** | (2006.01) |
| ***B24B 5/38*** | (2006.01) |
| ***B24B 33/08*** | (2006.01) |
| ***B24B 23/00*** | (2006.01) |
| ***B24B 47/12*** | (2006.01) |
| ***B24B 27/00*** | (2006.01) |

(52) U.S. Cl.
CPC . *B24B 5/00* (2013.01); *B08B 9/023* (2013.01); *B24B 5/38* (2013.01); *B24B 23/005* (2013.01); *B24B 23/02* (2013.01); *B24B 27/003* (2013.01); *B24B 33/04* (2013.01); *B24B 33/081* (2013.01); *B24B 47/12* (2013.01)

(58) Field of Classification Search
CPC ..... B24B 33/04; B24B 5/00; B24B 5/38; B24B 23/02; B24B 23/005; B24B 27/003; B08B 9/02; B08B 9/023
USPC ..... 451/51, 194, 195, 231, 348, 358, 360
See application file for complete search history.

(56) References Cited

U.S. PATENT DOCUMENTS 2,225,272 A * 12/1940 Horne ..... 15/4
3,188,674 A * 6/1965 Hobbs ..... 15/179

(Continued)

FOREIGN PATENT DOCUMENTS

CN 202317953 * 7/2012

*Primary Examiner* — Eileen Morgan

(57) ABSTRACT

An external circular polisher with double polishing wheels includes: a first polishing wheel having a first internal circular surface; a second polishing wheel having a second internal circular surface; a plurality of holders mounted on the first internal circular surface and the second internal circular surface; a plurality of polishing units connected to the holders for polishing a target external circular surface; a driving unit for driving the first polishing wheel and the second polishing wheel; and a supporter for supporting the first polishing wheel and the second polishing wheel. With the foregoing structure, a user can polish a target with two polishing wheels at the same time, and the external circular polisher works stably; the present invention can be driven by a motor of a conventional device for further increasing a scope of application of the external circular polisher with double polishing wheels.

8 Claims, 7 Drawing Sheets

(56) References Cited

U.S. PATENT DOCUMENTS

| | | | | |
|---|---|---|---|---|
| 5,038,525 | A * | 8/1991 | Gardner | 451/439 |
| 5,168,660 | A * | 12/1992 | Smith | 451/462 |
| 6,153,016 | A * | 11/2000 | Rauch et al. | 134/6 |
| 6,983,508 | B2 * | 1/2006 | Saurer | 15/104.04 |
| 7,413,505 | B1 * | 8/2008 | Rowlen, Jr. | 451/355 |
| 2012/0045978 | A1 * | 2/2012 | Mueller | 451/548 |
| 2012/0088442 | A1 * | 4/2012 | Huang et al. | 451/442 |

* cited by examiner

EXTERNAL CIRCULAR POLISHER WITH DOUBLE POLISHING WHEELS

CROSS REFERENCE OF RELATED APPLICATION

This is a U.S. National Stage under 35 U.S.C 371 of the International Application PCT/CN2013/080587, filed Aug. 1, 2013.

BACKGROUND OF THE PRESENT INVENTION

1. Field of Invention

The present invention relates to an external circular polisher, and more particularly to an external circular polisher with double polishing wheels.

2. Description of Related Arts

The conventional hand polisher has a good polishing effect on planes and surfaces with low curvature. However, when polishing a circumference surface, uneven polishing will happen and work efficiency will be greatly reduced; and vibration of the conventional hand polisher can also lower the polishing effect; at the meantime, each conventional hand polisher has a bundled motor, which not only means the conventional hand polisher can only be sold with its bundled motor, but also means a higher cost; further more, designs of polishing units of the conventional hand polishers are unitary, which seriously affects the adaptability.

SUMMARY OF THE PRESENT INVENTION

An object of the present invention is to provide an external circular polisher with double polishing wheels, which has a high work efficiency and good effect.

Another object of the present invention is to provide an external circular polisher with double polishing wheels, which works stably and is convenient to work with.

Accordingly, in order to accomplish the above objects, the present invention provides an external circular polisher with double polishing wheels, comprising:

a first polishing wheel having a first internal circular surface, wherein the first polishing wheel rotates around an axis, the axis is perpendicular to a plane where the first polishing wheel is provided and passes through a first center of the first polishing wheel, the first polishing wheel has a first rotation direction;

a second polishing wheel having a second internal circular surface, wherein the axis passes through a second center of the second polishing wheel, the second polishing wheel is parallel to the first polishing wheel and rotates around the axis, the polishing wheel has a second rotation direction, the first rotation direction is opposite to the second rotation direction;

a plurality of holders mounted on and moving with the first internal circular surface and the second internal circular surface;

a plurality of polishing units connected to the holders and extending from the holders to the first center or the second center cooperating to the polishing units for polishing a target external circular surface, wherein the target external circular surface is looped by the first internal circular surface and the second internal circular surface, when the first polishing wheel and the second polishing wheel rotate, the polishing units moves for evenly polishing the target external circular surface;

a driving unit for driving the first polishing wheel and the second polishing wheel to rotate with an outer power; and a supporter connected to the driving unit for supporting the first polishing wheel and the second polishing wheel;

wherein when polishing, a first resistance on the first polishing wheel counteracts a second resistance on the second polishing wheel to maintain the external circular polisher stable.

With the foregoing structure, a user can polish a target with two polishing wheels at the same time for improving working efficiency; when polishing, the polishing wheels loop on the target external circular surface, the polishing units contact with the target external circular surface in such a manner that the external circular surface is evenly polished when the polishing wheels are rotating; further more, the first resistance on the first polishing wheel counteracts the second resistance on the second polishing wheel in such a manner that the external circular polisher works stably.

These and other objectives, features, and advantages of the present invention will become apparent from the following detailed description, the accompanying drawings, and the appended claims.

Figure 1:
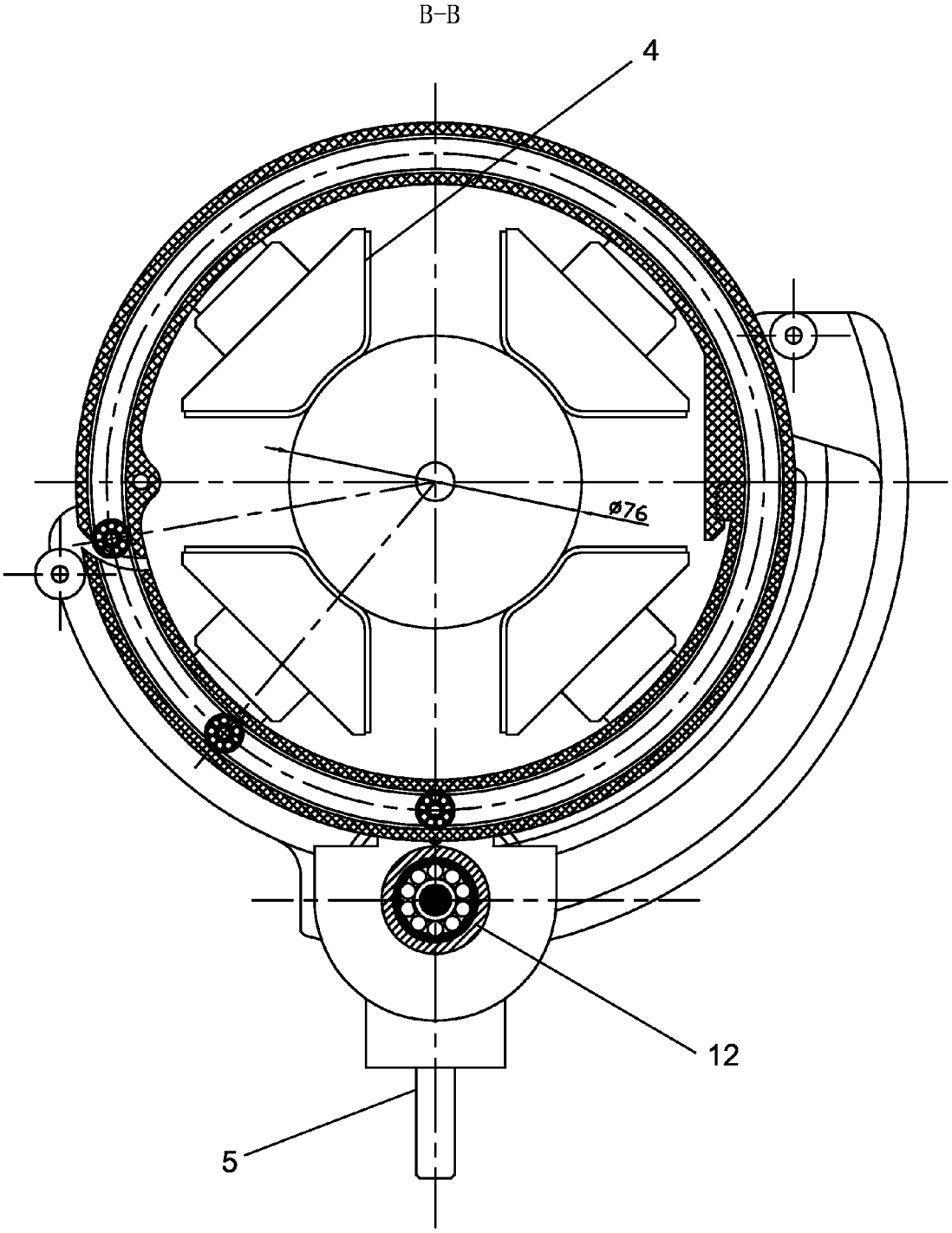
FIG. 1 is a structure view of the present invention according to a preferred embodiment of the present invention.
Figure 2:
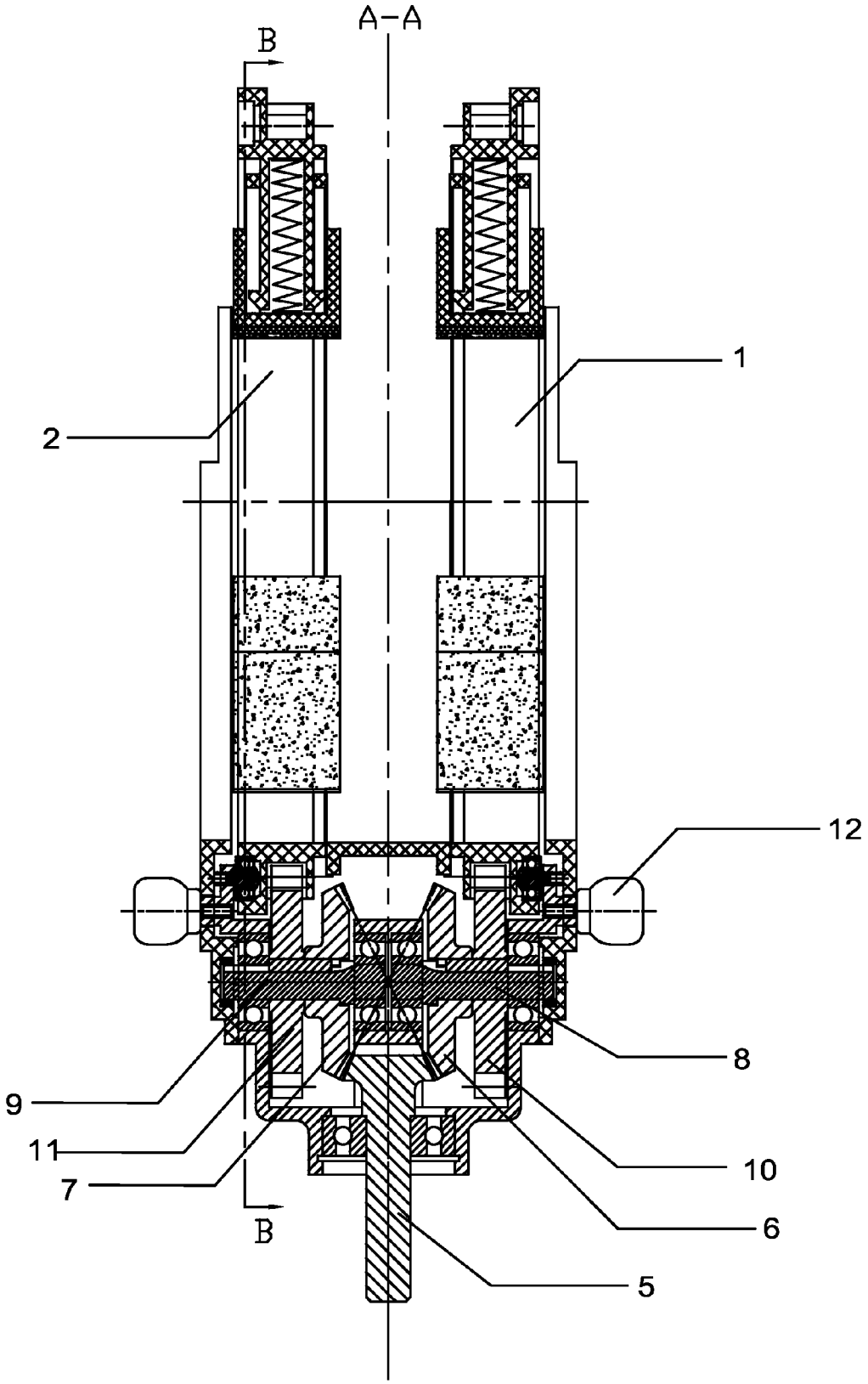
FIG. 2 is an A-A sectional view of the present invention according to the preferred embodiment of the present invention.
Figure 3:
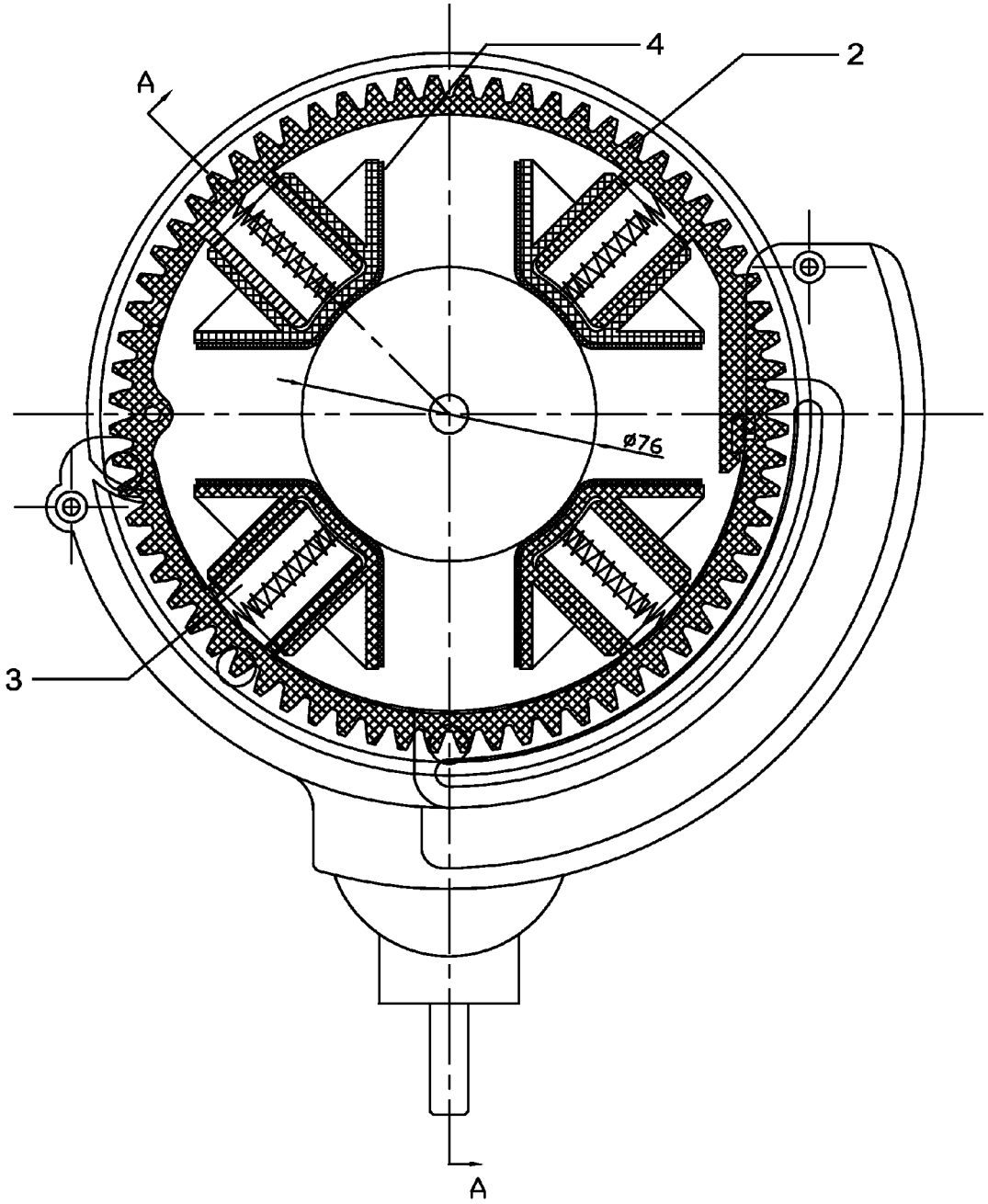
FIG. 3 is a sectional view of polishing wheels according to the preferred embodiment of the present invention.
Figure 4:
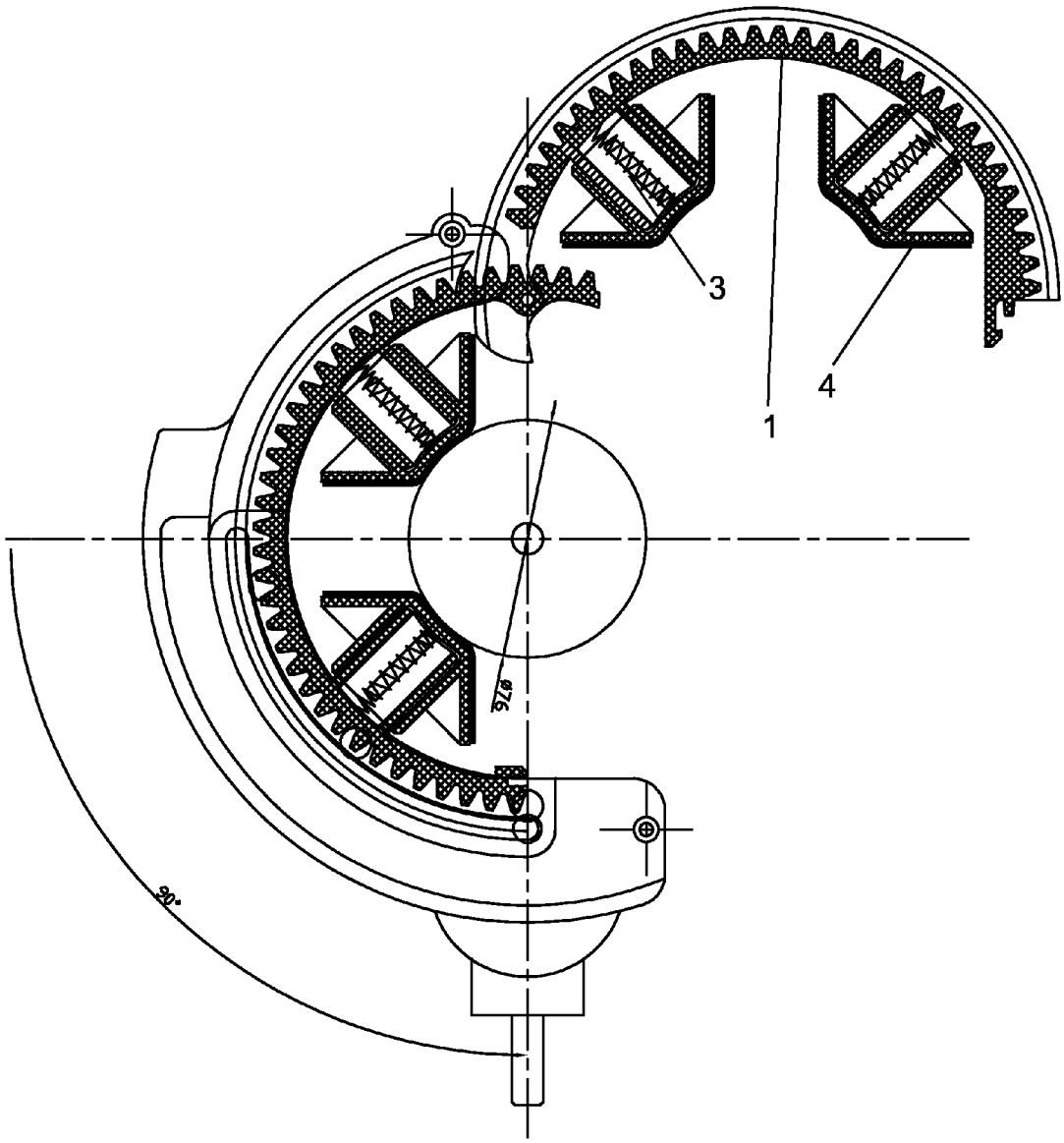
FIG. 4 is a sketch view of opening states of the polishing wheel according to the preferred embodiment of the present invention.
Figure 5:
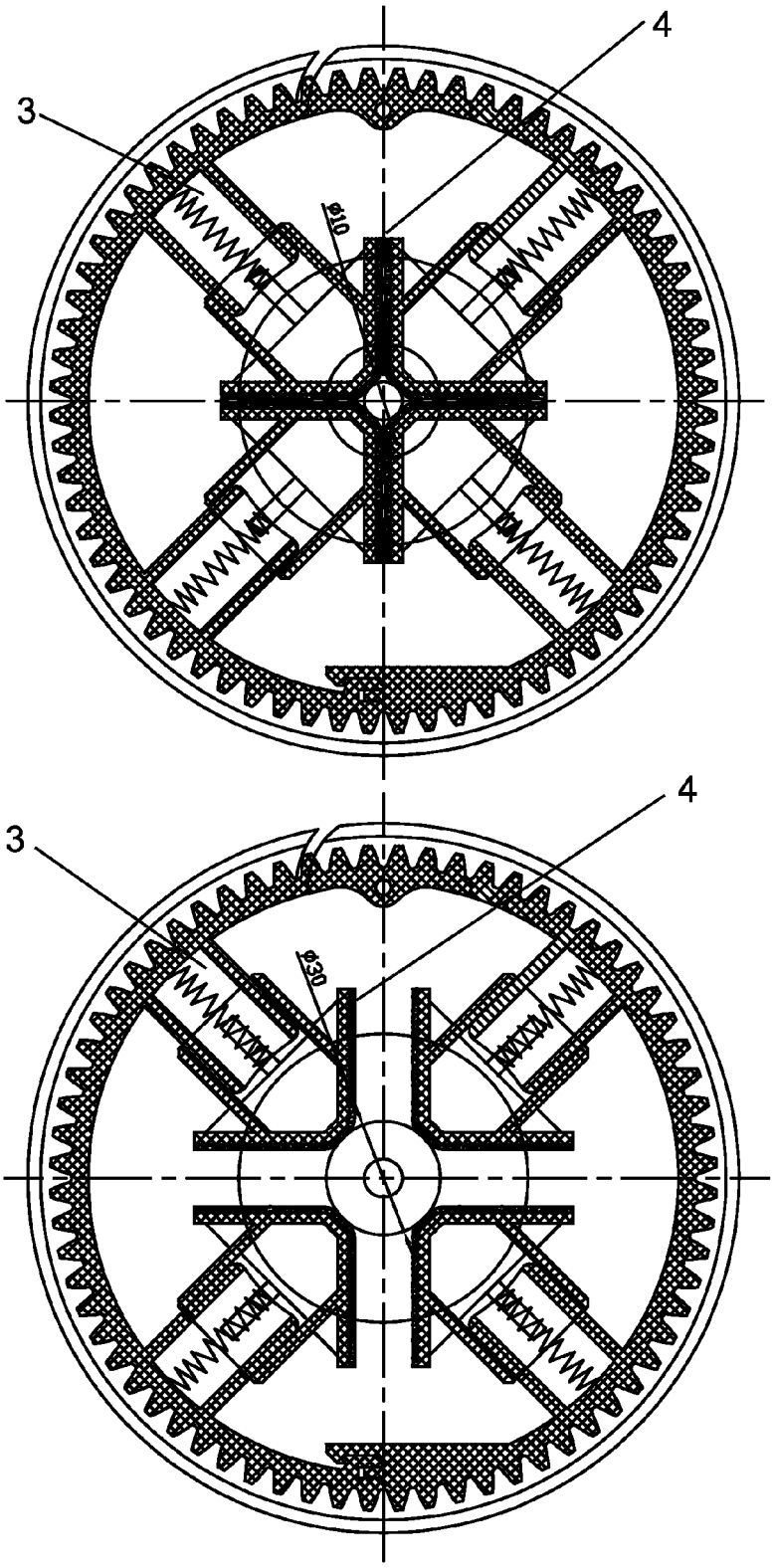
FIG. 5 is a sketch view of a polishing sander with a small external diameter according to the preferred embodiment of the present invention.
Figure 6:
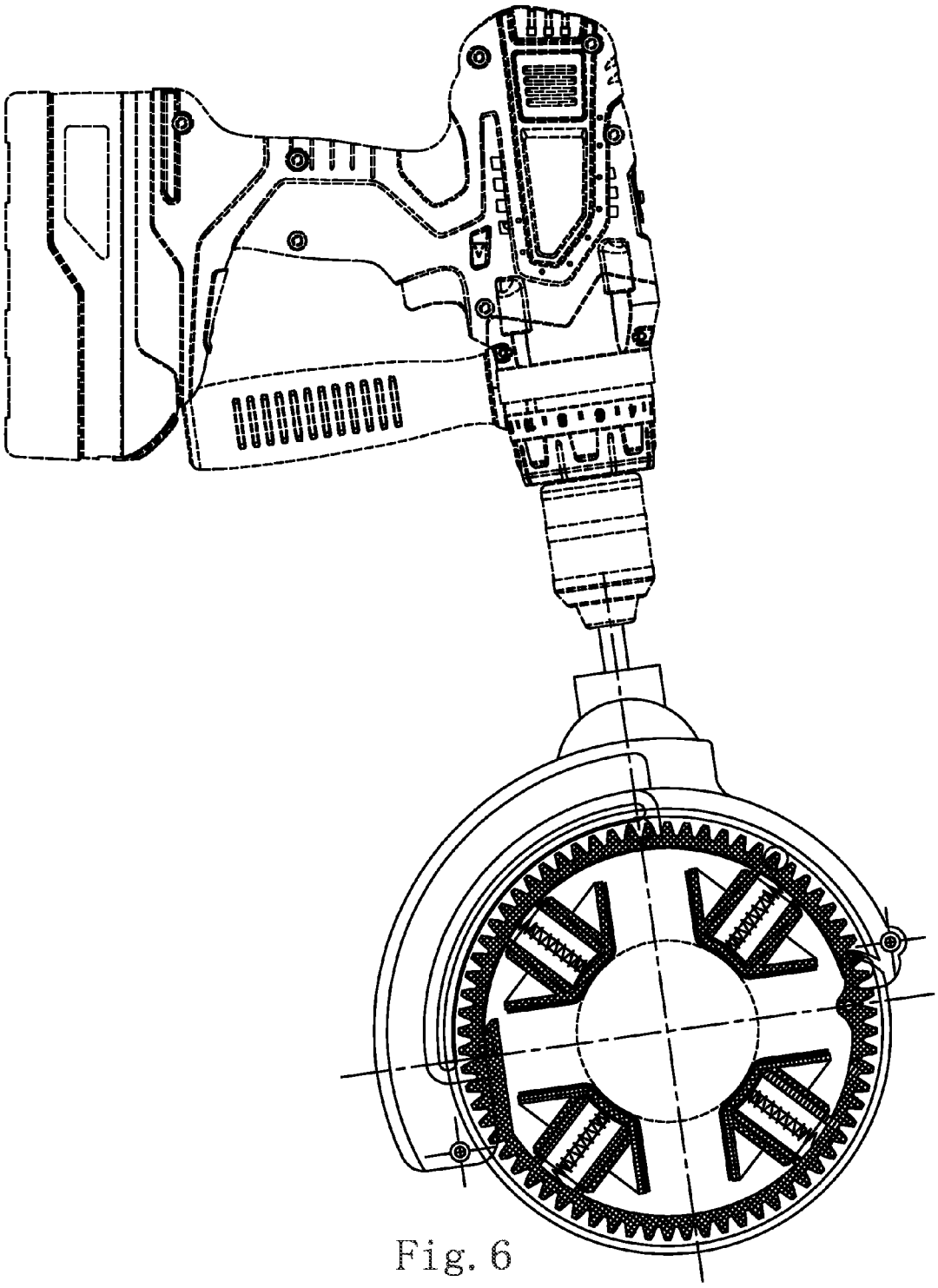
FIG. 6 is a sketch view of the present invention when connected to an electric drill according to the preferred embodiment of the present invention.
Figure 7:
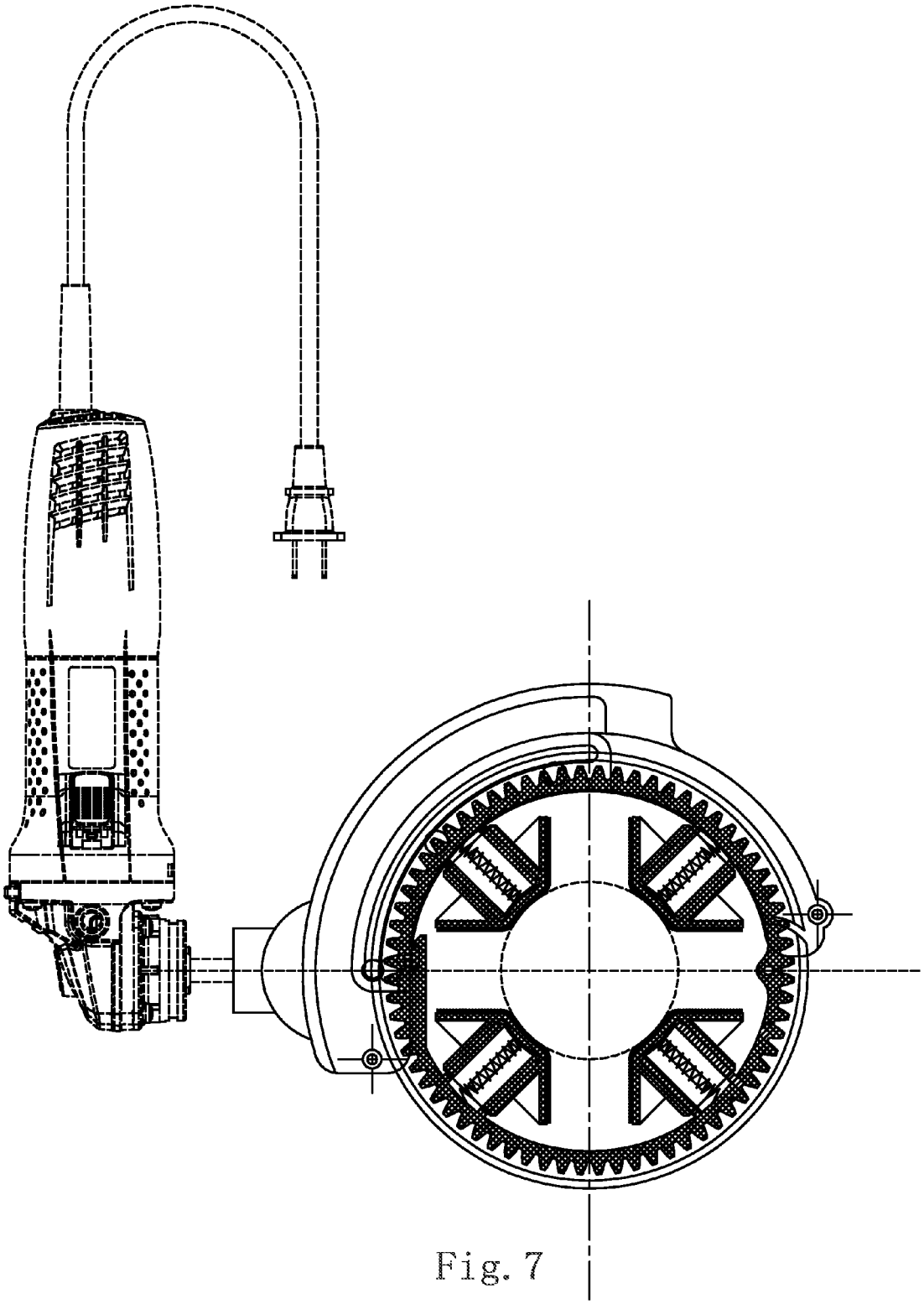
FIG. 7 is a sketch view of the present invention when connected to an angle grinder according to the preferred embodiment of the present invention.

Reference numbers of elements: 1—first polishing wheel, 2—second polishing wheel, 3—holder, 4—polishing unit, 5—small bevel gear, 6—first big bevel gear, 7—second big bevel gear, 8—first axle, 9—second axle, 10—first straight gear, 11—second straight gear, 12 locking knob.

DETAILED DESCRIPTION OF THE PREFERRED EMBODIMENT

Referring to the drawings, an external circular polisher with double polishing wheels according to a preferred embodiment of the present invention is illustrated, comprising:

a first polishing wheel 1 having a first internal circular surface, wherein the first polishing wheel 1 rotates around an axis, the axis is perpendicular to a plane where the first polishing wheel 1 is provided and passes through a first center of the first polishing wheel 1, the first polishing wheel 1 has a first rotation direction;

a second polishing wheel 2 having a second internal circular surface, wherein the axis passes through a second center of the second polishing wheel 2, the second polishing wheel 2 is parallel to the first polishing wheel 1 and rotates around the axis, the polishing wheel 2 has a second rotation direction, the first rotation direction is opposite to the second rotation direction;

a plurality of holders 3 mounted on and moving with the first internal circular surface and the second internal circular surface;

a plurality of polishing units 4 connected to the holders 3 and extending from the holders 3 to the first center or the second center cooperating to the polishing units for polishing a target external circular surface, wherein the target external circular surface is looped by the first internal circular surface and the second internal circular surface, when the first polishing wheel 1 and the second polishing wheel 2 rotate, the polishing units 4 moves for evenly polishing the target external circular surface;

a driving unit for driving the first polishing wheel 1 and the second polishing wheel 2 to rotate with an outer power; and a supporter connected to the driving unit for supporting the first polishing wheel 1 and the second polishing wheel 2;

wherein when polishing, a first resistance on the first polishing wheel 1 counteracts a second resistance on the second polishing wheel 2 to maintain the external circular polisher stable.

With the foregoing structure, a user can polish a target with two polishing wheels at the same time for improving working efficiency; when polishing, the polishing wheels loop on the target external circular surface, the polishing units 4 contact with the target external circular surface in such a manner that the external circular surface is evenly polished when the polishing wheels 1, 2 are rotating; further more, the first resistance on the first polishing wheel 1 counteracts the second resistance on the second polishing wheel 2 in such a manner that the external circular polisher works stably.

Preferably, the holders 3 are averagely distributed on the first internal circular surface and the second internal circular surface in such a manner that a polishing effect is improved and the first resistance further counteracts the second resistance.

Preferably, the first polishing wheel 1 comprises first gear teeth provided on a first external circular surface, the second polishing wheel 2 comprises second gear teeth provided on a second external circular surface;

wherein the driving unit comprises:

a small bevel gear 5 driven by the outer power;

a first big bevel gear 6 mounted on a first axle 8;

a second big bevel gear 7 mounted on a second axle 9, wherein the first axle 8 and the second axle 9 are provided in line, the first big bevel gear 6 and the second big bevel gear 7 are respectively engaged with the small bevel gear 5, the small bevel gear 5 respectively drives the first big bevel gear 6 and the second big bevel gear 7 to rotate, the first big bevel gear 6 and the second big bevel gear 7 respectively drive the first axle 8 and the second axle 9 to rotate;

a first straight gear 10 mounted on the first axle 8; and a second straight gear 11 mounted on the second axle 9, wherein the first straight gear 10 and the second straight gear 11 are respectively engaged with the first gear teeth and the second gear teeth, the first axle 8 and the second axle 9 respectively drive the first straight gear 10 and the second straight gear 11 to rotate, the first straight gear 10 and the second straight gear 11 respectively drives the first gear teeth and the second gear teeth to rotate.

With the foregoing structure, the small bevel gear 5 can be driven by a conventional electric drill or a conventional angle grinder, that is to say, the external circular polisher according to the present invention can be driven by a motor of a conventional device in such a manner that there is no need to buy a new motor and a cost is decreased.

Preferably, the first polishing wheel 1 has a first upper portion and a first lower portion, a first end of the first upper portion is connected to a first end of the first lower portion by a first connecting shaft, a second end of the first upper portion is connected to a second end of the first lower portion by a first releasable fastener; the second polishing wheel 2 has a second upper portion and a second lower portion, a first end of the second upper portion is connected to a first end of the second lower portion by a second connecting shaft, a second end of the second upper portion is connected to a second end of the second lower portion by a second releasable fastener.

With the foregoing structure, the releasable fasteners are opened before using, and the polishing wheels rotate around the connecting shafts for being opened and looping on the target external circular surface, then the polishing wheels and the releasable fasteners are closed for finishing preparation.

Preferably, the polishing unit 4 further comprises a spring mounted on the holder 3 in such a manner that the polishing unit fits the target external circular surface and provides a pressure for limiting a relative position of the target external circular surface and enhancing stability.

Preferably, the polishing unit 4 has an extending range with the spring for fitting and polishing an irregular external surface.

Preferably, the polishing unit 4 is a first polishing sander for polishing an external circular surface with an external diameter of 10~30 cm.

Preferably, the polishing unit 4 is a second polishing sander for polishing an external circular surface with an external diameter of 30~76 cm.

With the foregoing structure, the polishing unit 4 squeezes and compresses the spring when contacting with the external circular surface for fitting external circular surfaces with different external diameters within a certain range.

Preferably, the polishing unit 4 is detachably mounted on the holder 3.

With the foregoing structure, the user can replace the polishing unit 4 for increasing a scope of application of the external circular polisher with double polishing wheels.

Preferably, the supporter has a groove, the driving unit slides along the groove for adjusting a relative position of the driving unit and the polishing wheels, and the driving unit comprises a locking knob 12 for locking the relative position of the driving unit and the polishing wheels.

With the foregoing structure, when using, the user can adjust the relative position of the driving unit and the polishing wheels according to actual requirements for fitting different working angles.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An external circular polisher with double polishing modules, comprising:

a first polishing module having a first internal circular surface, wherein said first polishing module rotates around an axis, said axis is perpendicular to a plane where said first polishing module is provided and passes through a first center of said first polishing module, said first polishing module has a first rotation direction;

a second polishing module having a second internal circular surface, wherein said axis passes through a second center of said second polishing module, said second polishing module is parallel to said first polishing module and rotates around said axis, said polishing module has a second rotation direction, said first rotation direction is opposite to said second rotation direction;

a plurality of holders respectively mounted on and moving with said first internal circular surface of the first polishing module and said second internal circular surface of the second polishing module;

a plurality of polishing units connected to said holders and extending from said holders to said first center or said second center cooperating to said polishing units for polishing a target external circular surface, wherein said target external circular surface is looped by said first internal circular surface and said second internal circular surface, when said first polishing module and said second polishing module rotate, said polishing units moves for evenly polishing said target external circular surface;

a driving unit for driving said first polishing module and said second polishing module to rotate with an outer power; and a supporter connected to said driving unit for supporting said first polishing module and said second polishing module;

wherein when polishing, a first resistance on said first polishing module counteracts a second resistance on said second polishing module to maintain the external circular polisher stable;

wherein said holders are averagely distributed on said first internal circular surface and said second internal circular surface in such a manner that a polishing effect is improved and said first resistance further counteracts said second resistance;

wherein said first polishing module comprises first gear teeth provided on a first external circular surface, said second polishing module comprises second gear teeth provided on a second external circular surface;

wherein said driving unit comprises:

a small bevel gear driven by said outer power;

a first big bevel gear mounted on a first axle;

a second big bevel gear mounted on a second axle, wherein said first axle and said second axle are provided in line, said first big bevel gear and said second big bevel gear are respectively engaged with said small bevel gear, said small bevel gear respectively drives said first big bevel gear and said second big bevel gear to rotate, said first big bevel gear and said second big bevel gear respectively drive said first axle and said second axle to rotate;

a first straight gear mounted on said first axle; and a second straight gear mounted on said second axle, wherein said first straight gear and said second straight gear are respectively engaged with said first gear teeth and said second gear teeth, said first axle and said second axle respectively drive said first straight gear and said second straight gear to rotate, said first straight gear and said second straight gear respectively drives said first gear teeth and said second gear teeth to rotate.

2. The external circular polisher, as recited in claim 1, wherein said first polishing module has a first upper portion and a first lower portion, a first end of said first upper portion is connected to a first end of said first lower portion by a first connecting shaft, a second end of said first upper portion is connected to a second end of said first lower portion by a first releasable fastener; said second polishing module has a second upper portion and a second lower portion, a first end of said second upper portion is connected to a first end of said second lower portion by a second connecting shaft, a second end of said second upper portion is connected to a second end of said second lower portion by a second releasable fastener.

3. The external circular polisher, as recited in claim 1, wherein said polishing unit further comprises a spring mounted on said holder in such a manner that said polishing unit fits said target external circular surface and provides a pressure for limiting a relative position of said target external circular surface and enhancing stability.

4. The external circular polisher, as recited in claim 3, wherein said polishing unit has an extending range with said spring for fitting and polishing an irregular external surface.

5. The external circular polisher, as recited in claim 1, wherein said polishing unit is a first polishing sander for polishing an external circular surface with an external diameter of 10~30 cm.

6. The external circular polisher, as recited in claim 1, wherein said polishing unit is a second polishing sander for polishing an external circular surface with an external diameter of 30~76 cm.

7. The external circular polisher, as recited in claim 1, wherein said polishing unit is detachably mounted on said holder.

8. The external circular polisher, as recited in claim 1, wherein said supporter has a groove, said driving unit slides along said groove for adjusting a relative position of said driving unit and said polishing modules, and said driving unit comprises a locking knob for locking said relative position of said driving unit and said polishing modules.

* * * * *